US005538357A

United States Patent [19]

Boswell, Sr.

[11] Patent Number: 5,538,357

[45] Date of Patent: Jul. 23, 1996

[54] ELEVATABLE AUTOMOBILE TURN-AROUND SYSTEM

[76] Inventor: Wallace E. Boswell, Sr., P.O. Box 1563, Easton, Pa. 18044-1563

[21] Appl. No.: 413,006

[22] Filed: Mar. 29, 1995

[51] Int. Cl.[6] ..... E01C 1/00

[52] U.S. Cl. ..... 404/1; 187/211; 104/38

[58] Field of Search ..... 404/1; 104/36–47, 104/245; 187/211

[56] References Cited

U.S. PATENT DOCUMENTS

| | | | |
|---|---|---|---|
| 3,589,066 | 6/1971 | Fisher | 49/35 |
| 4,716,837 | 9/1988 | Valencia | 104/38 |
| 5,090,508 | 2/1992 | Nishikawa | 187/211 |

FOREIGN PATENT DOCUMENTS

| | | | |
|---|---|---|---|
| 6316902 | 11/1994 | Japan | 404/1 |
| 415543 | 5/1933 | United Kingdom | 404/1 |

*Primary Examiner*—Michael P. Buiz
*Assistant Examiner*—Pamela A. O'Connor

[57] ABSTRACT

An elevatable automobile turn-around system for use and association with various automobiles transport structures, the apparatus comprising: a lift having an upper segment, a lower segment and a central segment therebetween, the upper and lower segments formed in a planar configuration, the central segment including a motorized device to move the upper segment vertically upward and downward, the motorized means being powerful enough to lift the weight of an automobile; and a turntable formed in a generally planar configuration with an upper surface and a lower surface, the upper surface having coupling devices to securely retain a vehicle thereupon, the lower portion of the turntable including motorized pivot means for rotating the upper surface up to one hundred and eighty degrees, the apparatus permitting the user to elevate and rotate a vehicle as required by the particular transport structure utilized therewith.

2 Claims, 5 Drawing Sheets

ELEVATABLE AUTOMOBILE TURN-AROUND SYSTEM

BACKGROUND OF THE INVENTION

1. Field of the Invention

The present invention relates to an elevatable automobile turn-around system and more particularly pertains to rotating motor vehicles up to one hundred and eighty degrees to facilitate traffic flow.

2. Description of the Prior Art

The use of turntables for automobiles is known in the prior art. More specifically, turntables for automobiles heretofore devised and utilized for the purpose of rotating automobiles positioned within the apparatus are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,172,422 to McBride a turntable for automobiles.

U.S. Pat. No. 5,106,246 to Chance discloses a movable platform for storing freight and automobiles.

U.S. Pat. No. 4,716,837 to Valencia discloses a automobile turntable.

Lastly, U.S. Pat. No. 3,566,798 to Peltzman discloses a automobile turntable.

In this respect, the elevatable automobile turn-around system according to the present invention substantially departs from the conventional concepts and designs of the prior art, and in doing so provides an apparatus primarily developed for the purpose of rotating motor vehicles up to one hundred and eighty degrees to facilitate traffic flow.

Therefore, it can be appreciated that there exists a continuing need for a new and improved elevatable automobile turn-around system which can be used for rotating motor vehicles up to one hundred and eighty degrees to facilitate traffic flow. In this regard, the present invention substantially fulfills this need.

SUMMARY OF THE INVENTION

In view of the foregoing disadvantages inherent in the known types of turntables for automobiles now present in the prior art, the present invention provides an improved elevatable automobile turn-around system. As such, the general purpose of the present invention, which will be described subsequently in greater detail, is to provide a new and improved elevatable automobile turn-around system and method which has all the advantages of the prior art and none of the disadvantages.

To attain this, the present invention essentially comprises a new and improved elevatable automobile turn-around system comprising, in combination: a highway system, the highway system including a plurality of lanes moving in a first direction and a plurality of lanes moving in a second direction, the highway system including a middle lane permitting automobiles to change from one direction to the other, the highway system including an excavated pit formed as a hollow generally rectangular shaped bore; a concrete container adapted to be positioned in the excavated pit of the highway system, the container having a floor, four upwardly extending side walls, and an open top, the open top having a larger length and width than the remainder of the container thereby forming an upper edge;

a lift device having an upper segment, a lower segment and a central segment therebetween, the lower segment formed in a planar generally configuration and positioned upon the floor of the concrete container, the lower segment including an electrically powered hydraulic motor extending upwardly therefrom and coupled to the central segment, the upper segment being formed in a planar generally rectangular configuration with an upper surface and a lower surface including coupling means, the central segment being formed of a plurality of generally rectangular shaped shafts positioned in a cris-cross configuration, each shaft including a plurality of apertures and being pivotally coupled to at least one other shaft, at least one shaft being pivotally coupled to the lower segment, at least one shaft being pivotally coupled to the upper segment, the hydraulic motor extending the shafts of the central segment upwardly or downwardly in the operative orientation; a turntable having an upper section, a lower section and central section therebetween, the upper and lower sections being formed in a planar generally rectangular configuration, the lower section being affixed to the upper segment of the lift device, the upper section being larger than the lower section and adapted to support an automobile in the operative orientation, the upper surface including four wheel lock devices, each wheel lock device being rotatably coupled to the upper section and adapted to securely couple an automobile to the turntable, the central segment including a plurality of platform wheel assemblies, the central segment including motorized means rotatably coupled to the platform wheel assemblies, the approximate center point of the central segment having a vertical axis around which the platform wheel assemblies rotate, the central segment being coupled to the upper segment to permit circular rotation of the upper segment up to one hundred and eighty degrees, the apparatus adapted to lift and rotate cars positioned thereupon to affect turning of an automobile in a thoroughfare without interrupting adjacent traffic; and a toll gate with a currency activated control device, the toll gate including a rotatably coupled elongated arm to regulate the flow of traffic therethrough, the currency activated control device requiring users to deposit a predetermined amount of currency to affect upward lifting of the arm, automobiles being able to pass through the toll gate with the arm in the up position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved elevatable automobile turn-around system which has all of the advantages of the prior art turn-around systems for automobiles and none of the disadvantages.

It is another object of the present invention to provide a new and improved elevatable automobile turn-around system which may be easily and efficiently manufactured and marketed.

It is further object of the present invention to provide a new and improved elevatable automobile turn-around system which is of durable and reliable constructions.

An even further object of the present invention is to provide a new and improved elevatable automobile turn-around system which is susceptible of a low cost of manufacture with regard to both materials and labor, and which accordingly is then susceptible of low prices of sale to the consuming public, thereby making such elevatable automobile turn-around system economically available to the buying public.

Still yet another object of the present invention is to provide a new and improved elevatable automobile turn-around system which provides in the apparatuses and methods of the prior art some of the advantages thereof, while simultaneously overcoming some of the disadvantages normally associated therewith.

Still another object of the present invention is to rotating motor vehicles up to one hundred and eighty degrees to facilitate traffic flow.

Lastly, it is an object of the present invention to provide a new and improved elevatable automobile turn-around system for use and association with various automobiles transport structures, the apparatus comprising: a lift having an upper segment, a lower segment and a central segment therebetween, the upper and lower segments formed in a planar configuration, the central segment including a motorized device to move the upper segment vertically upward and downward, the motorized means being powerful enough to lift the weight of an automobile; and a turntable formed in a generally planar configuration with an upper surface and a lower surface, the upper surface having coupling devices to securely retain a vehicle thereupon, the lower portion of the turntable including motorized pivot means for rotating the upper surface up to one hundred and eighty degrees, the apparatus permitting the user to elevate and rotate a vehicle as required by the particular transport structure utilized therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
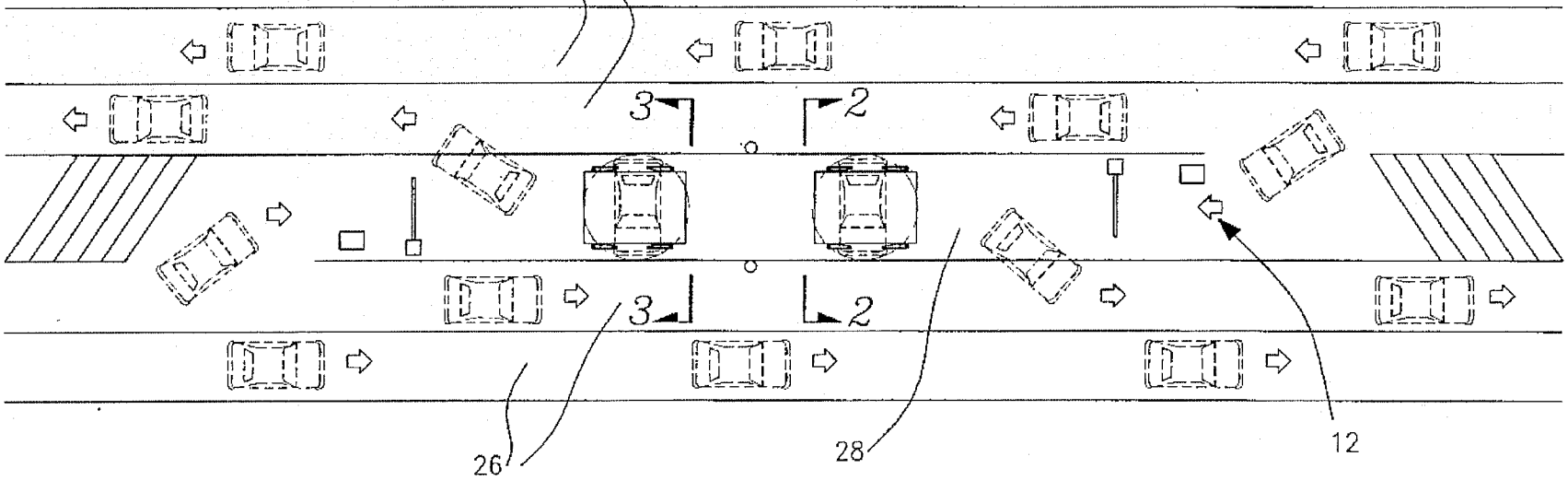
FIG. 1 is a perspective view of the preferred embodiment of the elevatable automobile turn-around system constructed in accordance with the principles of the present invention.
Figure 3:
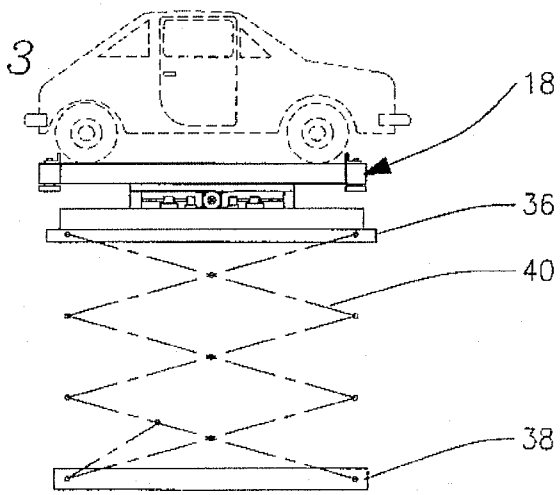
FIGS. 2 and 3 are side perspective illustrations of the apparatus in an extended orientation with automobiles positioned upon it.
Figure 2:
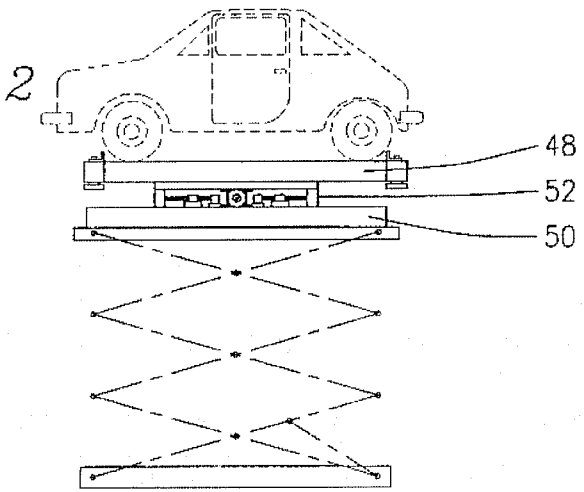

With reference now to the drawings, and in particular to FIG. 1 thereof, the preferred embodiment of the new and improved elevatable automobile turn-around system embodying the principles and concepts of the present invention and generally designated by the reference numeral 10 will be described.

The present invention, the elevatable automobile turn-around system 10 is comprised of a plurality of components. Such components in their broadest context include a highway system 12, a concrete container 14, a lift device 16, a turntable 18 and a toll gate 20. Such components are individually configured and correlated with respect to each other so as to attain the desired objective.

More specifically, the highway system 12 includes a plurality of lanes 24 which move in a first direction and a plurality of lanes 26 which move in a second direction. The highway system also includes a middle lane 28 permitting automobiles to change from one direction to the other. The highway system includes an excavated pit 30 formed as hollow generally rectangular shaped bore. In an alternative embodiment to the apparatus, the highway includes a plurality of excavated pits. The pits permit the below ground placement of the elevatable automobile turnaround systems within them. The lift device of the system may be adjusted to accommodate the height requirements of the particular highway system which utilizes the apparatus. Note FIGS. 1 and 7–9.

A concrete container 14 is adapted to be positioned in the excavated pit of the highway system. The container has a floor 32, four upwardly extending side walls, and an open top 34. The open top has a larger length and width than the remainder of the container thereby forming an upper edge. In this configuration the shafts are easily expanded upward in an accordion-like fashion. Likewise, they may be retracted in an accordion-like fashion. Note FIGS. 7 and 8.

In the preferred embodiment of the apparatus the two upper and lower shafts are coupled to the upper and lower segments. This configuration provides a secure and stable base for the apparatus. Depending on the type of structure being utilized with the apparatus, the central segment may be expanded to a variety of different heights. In an alternative embodiment, the system is used with a bridge structure. In such embodiment an automobile must be rotated and raised to a high vertical height to permit entrance onto a bridge. The preferred embodiment of the apparatus is adapted to be utilized with roads having a narrow median strip. The lift raises automobiles several meters off the ground so that it may be rotated well above adjacent traffic. Note FIGS. 7, 8 and 9.

A lift device 16 has an upper segment 36, a lower segment 38 and a central segment 40 therebetween. The lower segment is formed in a planar, generally rectangular configuration and is positioned upon the floor of the concrete container. The lower segment includes an electrically powered hydraulic motor 42 which extends upwardly from its surface. The motor is coupled to the central segment. The motor is operatively coupled to the upper segment to permit easy control by the user. Note FIGS. 8 and 9.

The upper segment 36 is formed in a planar, generally rectangular configuration. The upper and lower surfaces of the upper segment include coupling means. The central segment is formed of a plurality of generally rectangular shaped shafts 44 positioned in a cris-cross configuration. Each shaft includes a plurality of apertures. Each shaft is pivotally coupled 46 to at least one other shaft. At least one shaft is pivotally coupled to the lower segment. At least one shaft is pivotally coupled to the upper segment. The hydraulic motor extends the shafts of the central segment in an upward or downward direction in the operative orientation. Note FIGS. 8 and 9.

In an alternative embodiment of the apparatus the lift device consists of at least one motorized hydraulic lift 90 formed in a generally cylindrical configuration. The lift includes at least one telescoped extension arm having a stationary outer region and a movable inner region. The inner region extends outside of the outer region to lift the upper segment. The inner region retracts within the outer region to lower the upper segment. Note FIG. 7.

Figure 6:
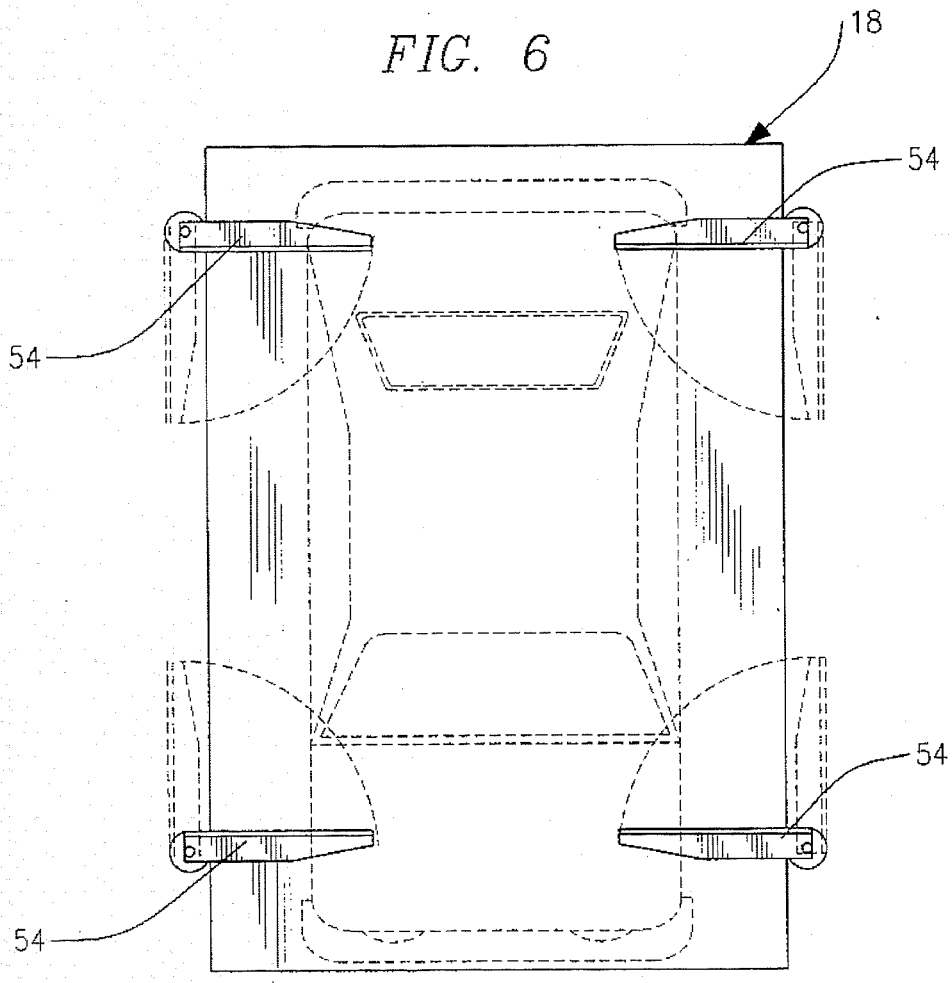
FIG. 6 is a top plan view of the apparatus with an automobile positioned upon it.
Figure 7:
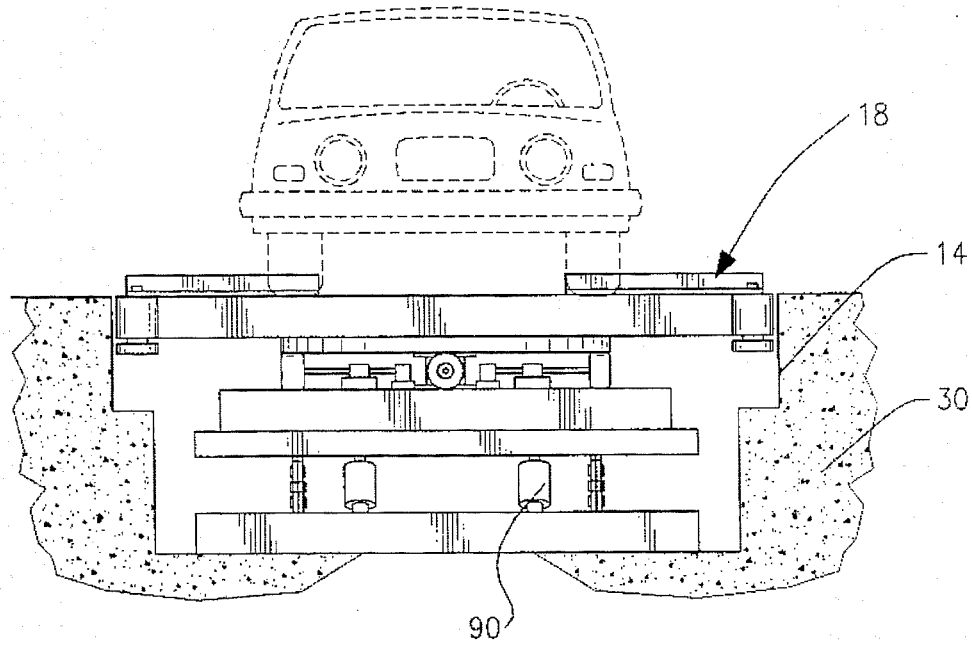
FIG. 7 is a front cross sectional view of the apparatus with a an automobile positioned upon it.
Figure 8:
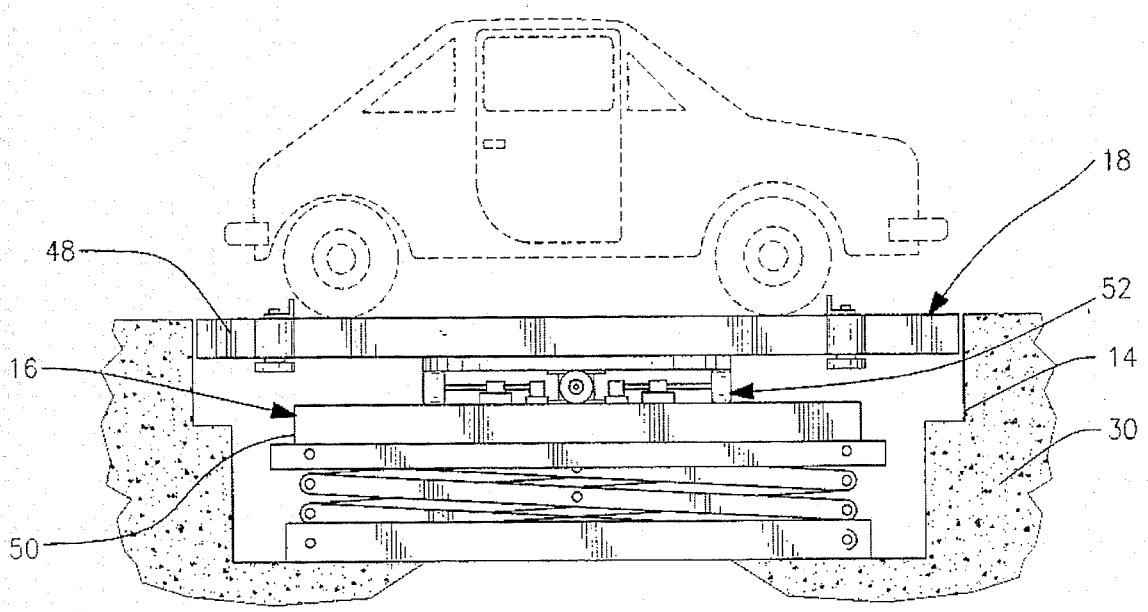
FIG. 8 is a side cross sectional view of the apparatus with an automobile positioned upon it.
Figure 9:
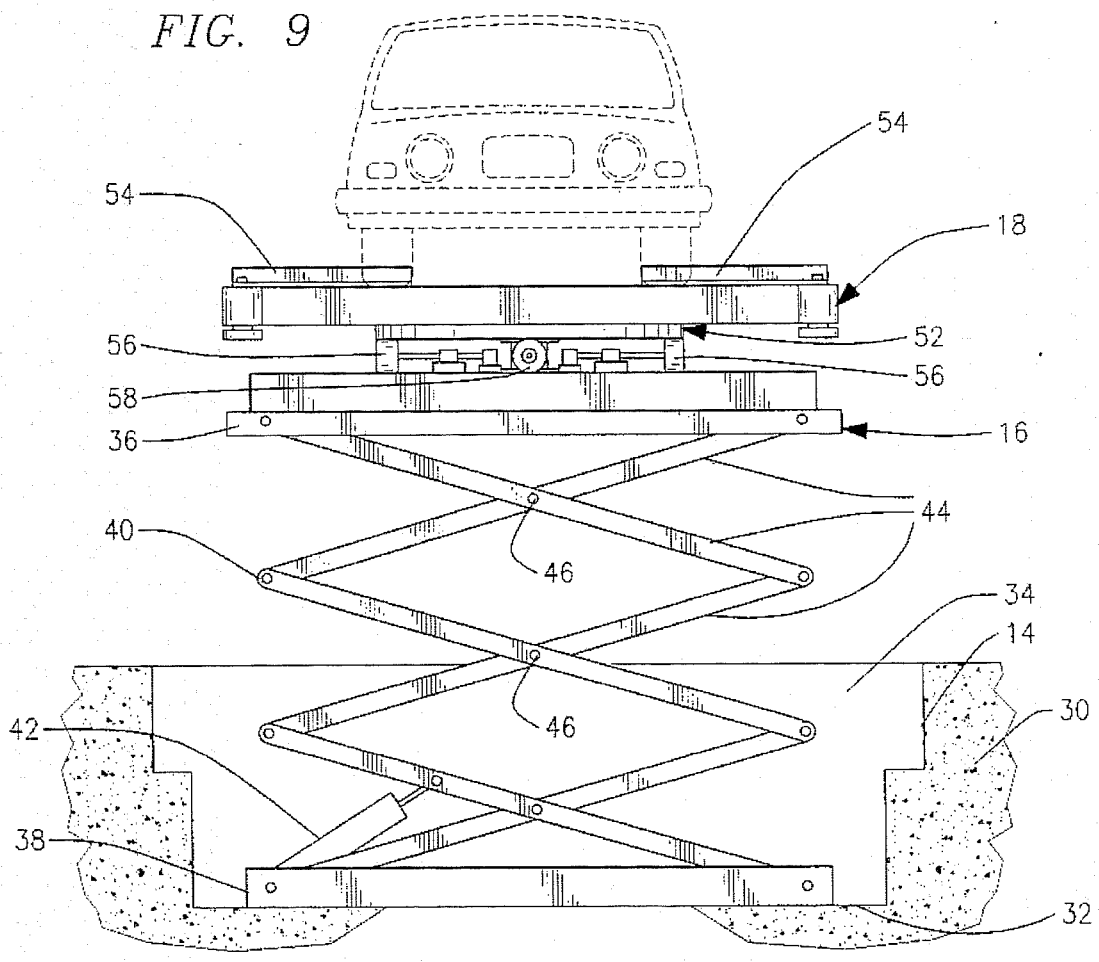
FIG. 9 is a rear perspective view of the apparatus in an extended orientation with an automobile positioned upon it.

A turntable 18 has an upper section 48, a lower section 50, and a central section therebetween 52. The upper and lower sections are formed in a planar, generally rectangular configuration. The lower section is affixed to the upper segment of the lift device. The upper section is larger than the lower section and is adapted to support an automobile in the operative orientation. The upper section is adapted to support vehicles of various sizes and configurations. The upper surface includes four wheel lock devices 54. Each wheel lock device is rotatably coupled to the upper section and is adapted to securely couple an automobile to the turntable. The wheel lock devices are formed in a generally rectangular configuration and are easily rotated to the locked orientation. When properly positioned the wheel lock devices become firmly wedged under the wheels of an automobile. Once positioned in the locked orientation, the wheel locks prevent an automobile from becoming dislodged while the apparatus is in motion. Note FIGS. 6 and 7.

The central segment includes a plurality of platform wheel assemblies 56. The central segment includes motorized means 58 which are rotatably coupled to the platform wheel assemblies. The approximate center point of the central segment has a vertical axis around which the platform wheel assemblies rotate. A plurality of ball bearings are operatively coupled to the platform wheel assemblies to facilitate rotation. The central segment is coupled to the upper segment to permit circular rotation of the upper segment up to one hundred and eighty degrees. The motor and hydraulic lift are operatively coupled to the upper segment. Note FIGS. 7 and 8.

When the wheel is locked onto the upper segment of the turntable, the motor becomes engaged and turns the apparatus to the desired degree of rotation. Vehicles only require a ninety degree rotation in order to be positioned upon a bridge. The apparatus is adapted to lift and rotate cars positioned upon it to affect turning of an automobile in a thoroughfare without interrupting adjacent traffic. In the preferred embodiment of the apparatus the turnaround is configured with a middle lane which enable drivers from either direction to drive onto the apparatus and be rotated at one hundred eighty degrees in order to change directions. Some highway systems require only one of the turntable lift devices, however, some require two or more. Note FIGS. 6–9.

Figure 10:
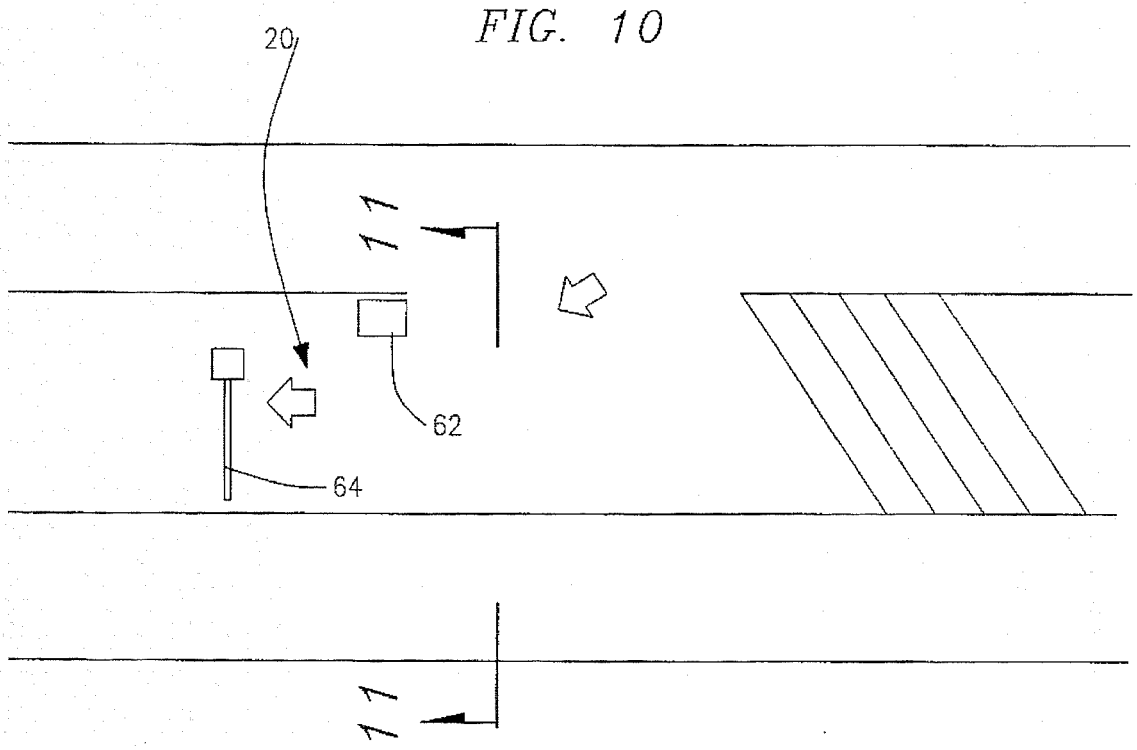
FIG. 10 is a top plan view of the toll area of a road system.
Figure 11:
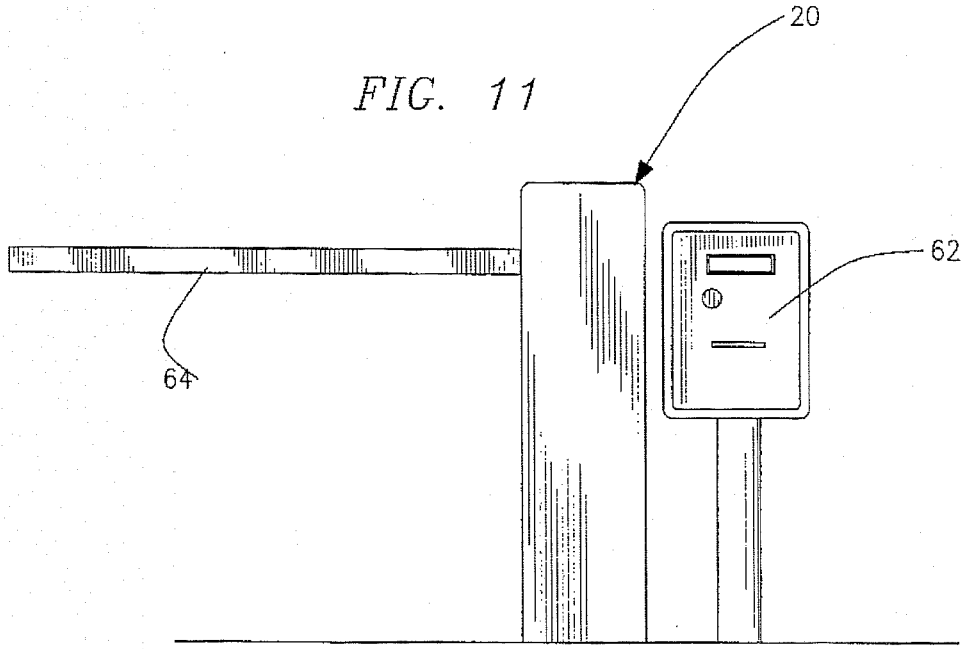
FIG. 11 is a front perspective view of a toll gate and coin meter.

A toll gate 20 with a currency activated control device 62 is included with the apparatus. The toll gate includes a rotatably coupled elongated arm 64 to regulate the flow of traffic through it. The currency activated control device requires users to deposit a predetermined amount of currency to affect upward lifting of the arm. Automobiles are able to pass through the toll gate when the arm is in the up position. To utilize the toll device users are simply required to deposit the proper amount of currency and the arm of the toll gate lifts vertically. When a car passes through the gate the arm comes back down in a horizontal orientation. The coin control device enhances the utility of the system by enabling municipalities purchasing the apparatus to have a means of recouping the investment in the apparatus. Note FIGS. 10 and 11.

In an alternative embodiment of the apparatus the elevatable automobile turn-around system is adapted for use in association with roads having median strips wide enough to completely rotate an automobile one hundred and eighty degrees. The lifts used in this apparatus are short so as to permit an automobile to be lifted a short distance above the road. In this embodiment there is no need for the automobile to be lifted above traffic.

Figure 4:
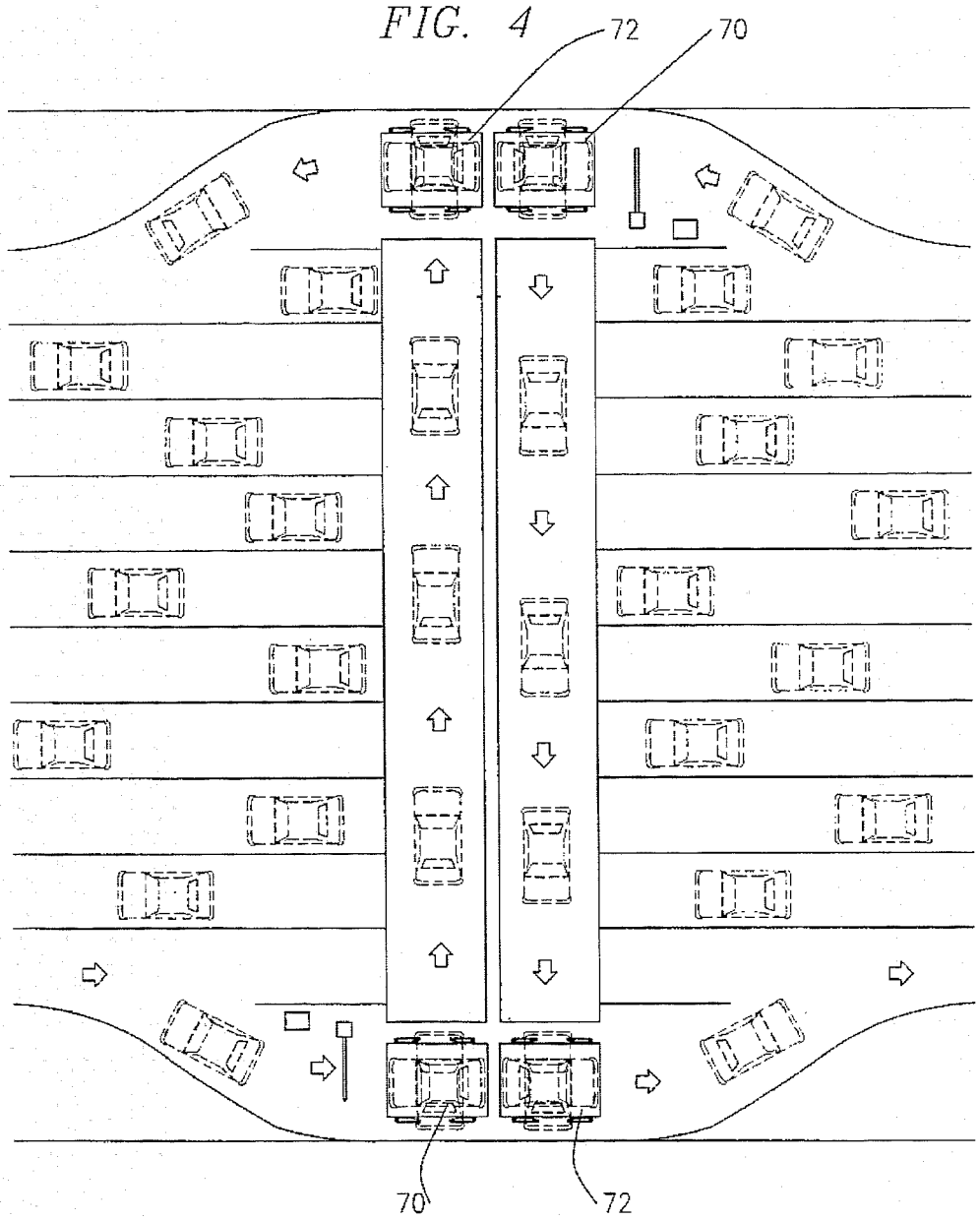
FIG. 4 is a top plan view of several elevatable automobile turn-around systems positioned at the ends of a highway overpass structure.

In another alternative embodiment of the apparatus the elevatable automobile turn-around system includes two lifts. This embodiment is adapted for use in association with roads not having median strips. The apparatus includes elongated lifts to permit automobiles to be lifted at least four meters above ground for traffic and road clearance. A first lift 70 rotates automobiles ninety degrees to permit entrance onto a bridge. Automobiles driving across the bridge and onto a second lift 72 are rotated ninety degrees while being lowered to the road. Note FIG. 4.

In another alternative embodiment of the apparatus the elevatable automobile turn-around system includes two lifts.

Figure 5:
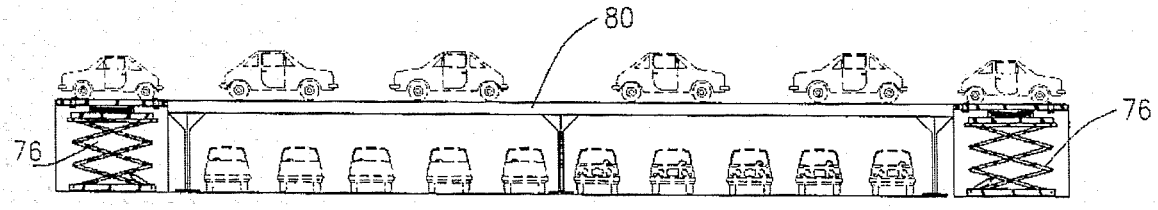
FIG. 5 is a side perspective illustration of two elevatable automobile turn-around systems positioned at the ends of a parking garage.

This embodiment is adapted for use in association with roads adjacent to shopping centers. The apparatus includes elongated lifts 76, 78 to permit automobiles to be lifted several meters above ground for traffic and road clearance. A first lift 76 receives automobiles from the shopping center area and rotates them ninety degrees to permit entrance onto a bridge 80. Automobiles then drive across the bridge and onto a second lift and are rotated ninety degrees while being lowered to the adjacent road. Note FIG. 5.

Most of the big cities in South East Asia are plagued with horrible traffic problems. A condition that contributes to this problem is that a car has to travel many kilometers before it can make a one hundred and eighty degree turn to go in the opposite direction. Also, when the car does make the turn he blocks traffic in two lanes, and sometimes three lanes in the direction he is turning. In addition, cars will line up in one lane and sometimes two lanes wanting to make the turn. This, of course, blocks the traffic in that direction, thus blocking traffic in both directions.

Besides solving a part of the traffic problem the traffic turn-a-round would collect tolls which would pay for the systems and contribute money to the cities to help solve other major traffic problems.

For the motorist it will help in two ways:

1. It will get the car to is destination sooner.

2. The motorist will save money and fuel.

Any device or plan that will get the car to its destination sooner will get the car out of traffic sooner thereby helping solve the traffic problem. The elevatable automobile turn-around system is a novel idea to help solve traffic problems.

The traffic turn-a-round can be of four types:

1. The elevatable automobile turn-a-round system for roads with a narrow median strip will require a lifting system that will lift the car well above the traffic, turn the car one hundred and eighty degrees, and lower the car back to the road level. This system is placed in the median strip between the two directions of traffic.

2. The elevatable automobile turn-a-round system for roads with median strips wide enough to completely turn the car one hundred and eighty degrees and a method of turning the elevatable automobile turn-around system in place or a few feet off the road level. This can be accomplished with a scissors lift, four air or hydraulic cylinders, or a method of raising hinged ends of the elevatable automobile turn-around system with hydraulic or air cylinders in order to provide clearance so the apparatus can turn the one hundred and eighty degrees.

3. This type of elevatable automobile turn-a-round system is for roads that do not have a median strip. This system requires the car to be lifted a minimum of four meters, for road and car clearance, turning the car ninety degrees on the way up, drives the car on the bridge to the other side of the road on to a second lift which lowers the car to the ground, turning the car ninety degrees so the car can drive off the apparatus in the opposite direction. The traffic turn-a-round is a combination of one or two lifting mechanisms, a turn-around system on each lifting unit, an automobile toll taking unit and one of two automatic control gates. This will contribute to solving the traffic problems in metropolitan areas of a city where changing the direction of travel is a major problem.

4. This type of elevatable automobile turn-a-round system is for shopping centers and areas that need a single apparatus to get to the opposite side of the road. This system would be a single lane apparatus with the entrance being in the shopping center area or the building from which the traffic is moving to the opposite side of the road. This elevatable automobile turn-a-round system would be a lift to turn the car ninety degrees, a bridge to take the car to the opposite side of the road, a lift to let the car down and turn it ninety degrees so that the car is going in the opposite direction from the direction of traffic on the side of the road the shopping center is or the building that wants to exit traffic to the other side of the street.

The elevatable automobile turn-around system is a device and means for turning a vehicle 180 degrees while on a thoroughfare, without slowing or stopping surrounding traffic. The system would be incorporated into the center median or alongside outside lanes on heavily traveled roads and highways. It is designed to permit vehicles desiring to change direction with a safe means for executing the change. Various configurations may be manufactured, but all consist of the same major base components and assemblies. Each requires a means for elevating the vehicle and rotating it one hundred and eighty degrees. This is accomplished using a turn table and a lift system.

The lift may be either a mechanical scissor-type, a hydraulic lift, or a combination of the two. It is positioned in a pit, with the turntable attached to the top of the system. The elevatable automobile turn-around system is controlled by a currency operated toll gate. The toll gate is positioned at the outside of the highway system. These turning points provide motorists with a safe and secure means for turning their vehicle around to travel in the opposite direction without disrupting traffic. The system eliminates the traffic jams and slowdowns that occur at major turning points, and can be installed in any location in a minimal amount of space.

The traffic turn-a-round system consists of:

1. A lifting mechanism which can be powered by hydraulics, air or electrically. The load bearing parts can be steel, aluminum or plastics. The system of lifting can be of the scissors type, or with air or hydraulic cylinders or electrically.

2. A elevatable automobile turn-around system that can be powered electrically, or with air or hydraulics. The turning mechanism can be of the air float type or a mechanical type.

3. A coin taker with a control system that controls a gate and automatically controls the lifting of the car. The turning of the car either ninety degrees or one hundred and eighty degrees whichever is needed. The traffic elevatable automobile turn-a-round system is in a concrete pit with the car deck level with the ground so a car can easily drive onto it. Proper caution and signal lights notify cars in traffic that the car elevatable automobile turn-a-round system is there and cautions them of cars either entering or leaving the car turn-a-round.

The first two types of elevatable automobile turn-a-round system could be accomplished with a single elevatable automobile turn-a-round system at each location, however better traffic control, safer traffic conditions and less traffic interference will result with a turn-a-round for each direction of traffic in the same location. There could be a single elevatable automobile turn-a-round system serving traffic in one direction. This would only be useful if there was a well traveled street on the opposite side of the road.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved elevatable automobile turn-around system comprising, in combination:

a highway system, the highway system including a plurality of lanes moving in a first direction and a plurality of lanes moving in a second direction, the highway system including a middle lane permitting automobiles to change from one direction to the other, the highway system including an excavated pit formed as a hollow generally rectangular shaped bore;

a concrete container adapted to be positioned in the excavated pit of the highway system, the container having a floor, four upwardly extending side walls, and an open top, the open top having a larger length and width than the remainder of the container thereby forming an upper edge;

a lift device having an upper segment, a lower segment and a central segment therebetween, the lower segment formed in a planar generally configuration and positioned upon the floor of the concrete container, the lower segment including an electrically powered hydraulic motor extending upwardly therefrom and coupled to the central segment, the upper segment being formed in a planar generally rectangular configuration with an upper surface and a lower surface including coupling means, the central segment being formed of a plurality of generally rectangular shaped shafts positioned in a cris-cross configuration, each shaft including a plurality of apertures and being pivotally coupled to at least one other shaft, at least one shaft being pivotally coupled to the lower segment, at least one shaft being pivotally coupled to the upper segment, the hydraulic motor extending the shafts of the central segment upwardly or downwardly in the operative orientation;

a turntable having an upper section, a lower section and central section therebetween, the upper and lower sections being formed in a planar generally rectangular configuration, the lower section being affixed to the upper segment of the lift device, the upper section being larger than the lower section and adapted to support an automobile in the operative orientation, the upper surface including four wheel lock devices, each wheel lock device being rotatably coupled to the upper section and adapted to securely couple an automobile to the turntable, the central segment including a plurality of platform wheel assemblies, the central segment including motorized means rotatably coupled to the platform wheel assemblies, the approximate center point of the central segment having a vertical axis around which the platform wheel assemblies rotate, the central segment being coupled to the upper segment to permit circular rotation of the upper segment up to one hundred and eighty degrees, the apparatus adapted to lift and rotate cars positioned thereupon to affect turning of an automobile in a thoroughfare without interrupting adjacent traffic; and a toll gate with a currency activated control device, the toll gate including a rotatably coupled elongated arm to regulate the flow of traffic therethrough, the currency activated control device requiring users to deposit a predetermined amount of currency to affect upward lifting of the arm, automobiles being able to pass through the toll gate with the arm in the up position.

2. An elevatable automobile turn-around system for use in association with various automobiles transport structures comprising:

a lift having an upper segment, a lower segment and a central segment therebetween, the upper and lower segments formed in a planar configuration, the central segment including a motorized device to move the upper segment vertically upward and downward, the motorized means being powerful enough to lift the weight of an automobile;

a turntable formed in a generally planar rectangular configuration with an upper surface, a lower surface, and side edges, the upper surface including four wheel lock devices formed in a generally rectangular configuration and rotatably coupled to the upper surface, the wheel lock devices being rotated whereby they become firmly wedged under the wheels of an automobile in a locked orientation, the wheel lock devices preventing an automobile from becoming dislodged while the system is in motion, the lower portion of the turntable including motorized pivot means for rotating the upper surface up to one hundred and eighty degrees, the elevatable automobile turn-around system permitting the user to elevate and rotate a vehicle as required by the particular transport structure utilized therewith; and a toll gate with a currency activated control device, the toll gate including a rotatably coupled elongated arm to regulate the flow of traffic therethrough, the currency activated control device requiring users to deposit a predetermined amount of currency to affect upward lifting of the arm, automobiles being able to pass through the toll gate with the arm in the up position.

* * * * *